US006775942B2

(12) United States Patent
Compton

(10) Patent No.: US 6,775,942 B2
(45) Date of Patent: Aug. 17, 2004

(54) ACCESSORY RAIL MOUNT ADAPTER FOR RIFLES AND CARBINES

(75) Inventor: David W. Compton, Kitchener (CA)

(73) Assignee: Diemaco, a division of Devtek Corporation, Kitchener (CA)

( * ) Notice: Subject to any disclaimer, the term of this patent is extended or adjusted under 35 U.S.C. 154(b) by 44 days.

(21) Appl. No.: 10/305,967

(22) Filed: Nov. 29, 2002

(65) Prior Publication Data

US 2004/0103577 A1 Jun. 3, 2004

(51) Int. Cl.[7] ..... F41C 23/00; F41C 27/00
(52) U.S. Cl. ..... 42/85; 42/114; 42/142
(58) Field of Search ..... 42/85, 112, 114, 42/115, 117, 142, 143, 146, 86, 111, 124, 106; D22/7, 110

(56) References Cited

U.S. PATENT DOCUMENTS

| | | | | | |
|---|---|---|---|---|---|
| 3,406,455 | A | * | 10/1968 | Akin, Jr. | 42/124 |
| 3,463,430 | A | * | 8/1969 | Rubin et al. | 42/124 |
| 3,550,300 | A | * | 12/1970 | Roder | 42/106 |
| 3,833,799 | A | * | 9/1974 | Audet | |
| 4,008,536 | A | * | 2/1977 | Adams | 42/112 |
| D259,944 | S | * | 7/1981 | Burris | D22/110 |
| D269,449 | S | * | 6/1983 | Bechtel | D22/110 |
| 4,683,662 | A | * | 8/1987 | Kiss, Jr. | |
| 4,941,277 | A | * | 7/1990 | Lawlor | 42/111 |
| 5,343,650 | A | * | 9/1994 | Swan | 42/117 |
| 5,826,363 | A | | 10/1998 | Olson | |
| 5,836,100 | A | * | 11/1998 | Stover | |
| D415,239 | S | * | 10/1999 | Fell et al. | D22/110 |
| D429,790 | S | * | 8/2000 | Plonka | D22/110 |
| 6,499,245 | B1 | * | 12/2002 | Swan | 42/124 |
| 6,508,027 | B1 | * | 1/2003 | Kim | 42/124 |
| 6,655,069 | B2 | * | 12/2003 | Kim | 42/114 |

* cited by examiner

*Primary Examiner*—Michael J. Carone
*Assistant Examiner*—L. Semunegus
(74) *Attorney, Agent, or Firm*—Dilip C. Andrade; Borden, Ladner, Gervais LLP

(57) ABSTRACT

An accessory mounting rail for a firearm, which enables mounting of firearm accessories to the barrel of the firearm and reduces the potential for parallax error in mounted sights is disclosed herein. The accessory mounting rail is formed from a complementary pair of mounting bracket sides that are hinged together and have an aperture for receiving the barrel of the firearm. The accessory mounting rail is secured to the firearm through the use of a fastener to connect the complementary mounting bracket sides, which have provided upon them accessory rails.

10 Claims, 6 Drawing Sheets

ACCESSORY RAIL MOUNT ADAPTER FOR RIFLES AND CARBINES

FIELD OF THE INVENTION

The present invention relates generally to accessory mounts for firearms. More particularly, the present invention relates to accessory mounts for rifles and carbines.

BACKGROUND OF THE INVENTION

It is common in the field of firearm design for accessories to be made available as an after market solution to common needs or desires not satisfied by a standard rifle or carbine. In the interest of compatibility a standardised connector rail has been developed that is a series of ridges and recesses with perpendicular sides and bases. Accessories such as laser and infra-red sights have been developed as a supplement to the optical sight that is commonly attached to the barrel of the rifle. These sights are offered as after market solutions for individuals seeking more versatile or accurate targeting methods. Other accessories such as bipods and stands are also available, as are more specialised devices that are designed as accompaniments to assault rifles. For a sight to be functional, it must be mounted so that it is coaxial with the barrel of the firearm. This allows the alignment of the sight to be maintained as the user of the firearm tracks a target.

The common method of attaching these accessories mounts is to attach one end of the accessory mounting rail to the stock of the rifle. This style of accessory rail typically mounts atop the handguard attached to the barrel of the rifle, and is additionally connected to the shoulder support that forms the butt of the weapon. These rails provide the user of the weapon with the ability to attach one or more accessories. It is known in the art that these rails can support attachments on more than one side of the weapon. This method of attaching to the stock of the rifle is unable to maintain a coaxial alignment with the barrel of the rifle, as the disassembly of a firearm for cleaning necessitates the removal of the handguard, which upon reattachment can introduce misalignment. Additionally, the stock of the rifle and the handguard are separate elements, and can be jarred from alignment during the discharging of the firearm, or through the handling of the weapon. Slight angular movement of the rail with respect to the barrel, which can be introduced through the shifting of the handguard or the stock, results in inaccuracy of the firearm system, as the accessory rail ballistic sight path will no longer correspond to the trajectory of the bullet launched from the barrel.

One notable accesory mount is described In U.S. Pat. No. 5,826,363 to Olson. This patent teaches the replacement of the handguard by a handguard with an Integral accessory rail. The accessory mount taught by Olson attaches directly to the barrel of the firearm, and secures to the stock, and the gas block.

During the use of the firearm, the barrel is heated by the combustion of the propellant in each round of firearm ammunition. This heating can cause heat based deformation of the accessory rail. Typically firearms are air-cooled, and the exterior surface of the barrel has been shown to achieve surface temperatures on the order of 300° C. depending on the rate of fire, number of rounds fired, and the exterior configuration of the barrel. In use, the barrel will be subject to rapid eating, and a slower cooling process, where the barrel will continue to increase to a maximum temperature after the rounds have been fired. In many conventional firearms, heating related problems are mitigated through mounting the accessory rail on the handguard which dissipates the heat, but results in a higher mounting point for the accessories. In serving as both the handguard and accessory rail, the devices taught by the Olson reference employ a leaf spring and rear clamp arrangement that attempts to compensate for thermal distortion and the mechanical forces exerted by firing ammunition, both of which contribute to misalignment of the rail. An accessory rail, as taught by the Olson reference, is located on the region of the barrel that is subject to greatest heating. Accessory alignment is affected by the the thermal expansion of the handguard/accessory rail, and the movement of linkages and attachment points resulting from the thermal expansion. Though the use of the leaf spring and rear clamp arrangement taught by Olson overcomes some of the problems caused by heat dissipation, the leaf spring and clamp increase the mass of the weapon, and result in a more complex weapon design, which is undesirable for reasons of cost, maintenance and reliability. The accessory rail of the Olson reference uses the leaf spring and rear clamp to affix the handguard accessory rail to the barrel of the rifle, and to maintain a coaxial alignment of the rail to the barrel. However, while in use with a bipod accessory stand attached to the rail, the rifle is subject to short an intermittent periods of force which result from the recoil associated with the discharge of a round of ammunition, these forces can cause coaxil misalignment of the one or more accessory mounting rails.

It is, therefore, desirable to provide an accessory rail for mounting on a firearm that reduces the potential for parallax error, while avoiding the use of complex and expensive mounting arrangements to allow for heat dissipation and compensate for thermal distortion.

SUMMARY OF THE INVENTION

It is an object of the present invention to obviate or mitigate at least one disadvantage of previous firearm accessory rails.

In a first embodiment of the present invention, there is provided a firearm accessory mounting rail for attachment of a firearm accessory to the barrel of a firearm having a sight attached to the barrel. The accessory mounting rail comprises an accessory rail and a mounting bracket. The accessory rail is for providing a connection for the firearm accessory. The mounting bracket is provided on the accessory rail to allow attachment of the accessory rail to the barrel of the firearm and for engaging the sight to impede movement of the accessory rail with relation to the barrel of the firearm in at least one direction. In an embodiment of the present invention the accessory rail is integrally formed with the mounting bracket, and the mounting bracket is sized for attachment to the barrel under the sight. In an alternate embodiment of the present invention, the mounting bracket is sized to abut the sight to impede movement of the accessory rail in line with the axis of the barrel. In another embodiment of the present invention, the mounting bracket is formed of two complementary sides, each side having a complementary recess that in combination define an aperture through which the barrel can be secured. In a further embodiment, each complementary side has an integrally formed accessory rail and complementary sides are pivotally hinged to each other at their bases, where they interlace to form an accessory rail. In another embodiment, firearm accessory mounting rail is securable to the barrel through the attachment of the complementary sides to each other, with a fastener. In a further embodiment, the recesses define an aperture sized to secure the mounting bracket to the barrel and at least a portion of the sight, to impede rotation of the accessory rail with respect to the axis of the barrel.

In an embodiment of the present invention the accessory sight is secured to the barrel at the gas block to reduce the potential for thermal distortion, and to allow a connection to both the barrel of the rifle and the sight that will allow for maintenance of the coaxial alignment of the accessory rail and the barrel.

The present invention makes the accessory rail mount coaxial and solid to the barrel, thereby providing a stable sight platform, for lasers and other sights, that is capable of moving with the barrel. By being located directly on the barrel at the gas block, which is contained within the front sight, the accessory mounting rail is not exposed to the same degree of thermal distortion, as the heat is less than if the accessory mounting rail had been mounted to the barrel in the region of the handguard. This minimises the heat input to the accessory rail and thereby minimises deformation. The accessory mounting rail of the present invention serves as a heat sink for the gas block to aid in the dissipation of heat from the cooler region of the barrel without causing misalignment of the accessory mounts due to thermal distortion. The accessory mounting rail does not substantially increase the mass of the firearm system, and thus does not detrimentally affect the firearm dynamics, nor is it a great inconvenience to the user. The accessory mounting rail also provides, in a presently preferred embodiment, a means for rapidly attaching and detaching from the barrel of the rifle.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figure 1:
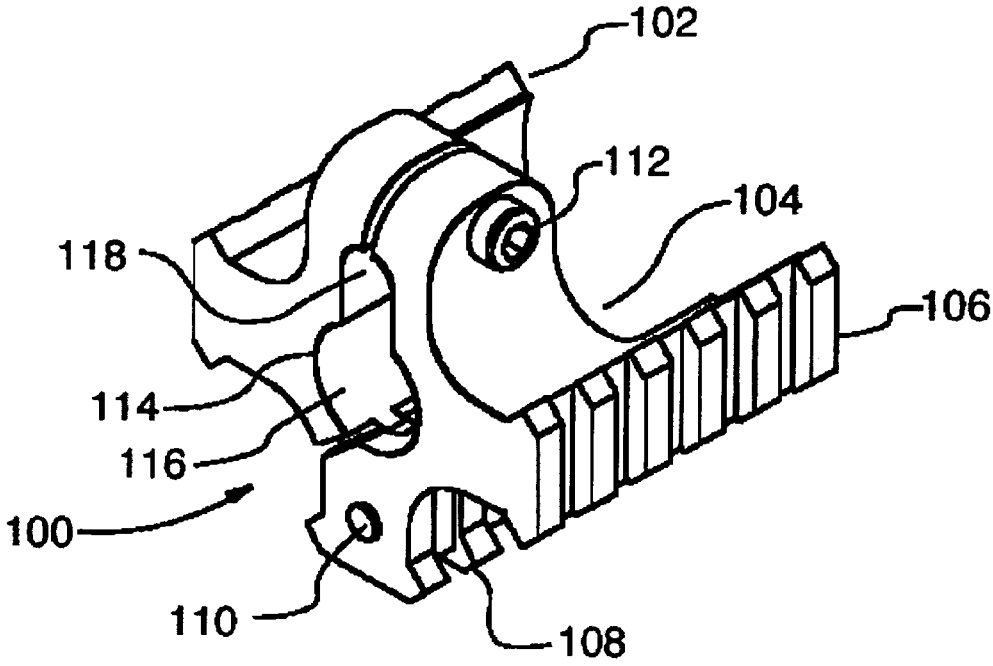
FIG. 1 is an illustration of an accessory mounting rail according to an embodiment of the present invention.

Generally, the present invention provides an accessory rail for mounting on a firearm that reduces the potential for parallax error and does not require a complex collection of elements for heat dissipation and thermal distortion correction.

As previously stated, the accuracy of a sight mounted to a firearm is dependant upon the ability to maintain the sight and barrel in coaxial alignment. Angular movement of the sight with respect to the barrel will result in misalignment and the sight path will no longer correspond to the trajectory of a bullet launched from the barrel. To maintain the sight and barrel in coaxial alignment, the barrel and accessory rail must be maintained in coaxial alignment. Whereas previous accessory rails implemented complex methods of attaching an accessory rail to the rifle stock and barrel that were designed to reduce angular movement, the present invention seeks to maintain coaxial alignment by being attached to only the barrel of the rifle and the sight attached to the gas block. A complex heat dissipation system is avoided through the location of the accessory rail on the barrel at the gas block, where the effects of thermal distortion are reduced. Locating the accessory mounting rail at the gas block minimises the heat input to the accessory rail and thus reduces potential for deformation of the accessory rail. It is common in many rifles to locate the manual iron sight at the gas block to take advantage of these beneficial thermal dissipation properties. A presently preferred embodiment of the present invention engages the barrel and sight at the gas block to maintain coaxial alignment and to take advantage of desired thermal properties. As the accessory rail of the present invention is preferably a metal rail, it will allow further heat dissipation, and act as a heat sink by allowing heat transferred from the gas block to be radiated by a larger surface area.

The present invention provides an accessory rail for mounting to the barrel of a firearm in the region of the built-in sight. On a typical rifle, a sight is located near the end of the barrel at the gas block, where the barrel has an enlarged diameter in comparison to its size closer to the stock of the rifle. As the firearm is used, heat energy, from the burning propellant of the cartridge, is conducted from the barrel chamber and internal bore to the exterior of the barrel. The barrel tends to have the maximum temperature between the barrel chamber at the rear and the gas block. As noted above, the gas block typically provides a mount for the front sight. Previous accessory rails have been mounted at the handguard, which is located at the hottest barrel region between the barrel chamber and the gas block. This heat energy can cause problems with thermal expansion and distortion of the handguard, which in turn may causes parallax error of a sight mounted on the accessory mounting rail as the distortion causes the rail to shift. The gas block region is substantially cooler than the handguard region of the barrel. It is known that the gas block acts as a heat sink to radiate the heat from the barrel making the gas block region ideal for mounting an accessory rail. Thus, an attachment mounted under the sight will not require a complex mounting arrangement to overcome thermal distortion.

As the accessory rail of the present invention is not located on a bulky attachment such as the handguard, it is able to be located at a level close to that of the barrel of the rifle. The location of the rail nearer the barrel contributes to the reduction in the potential for parallax error in a sight. Additionally, the region of the barrel that the accessory rail is mounted to is also used for the manual sight of the weapon. This provides a uniquely advantageous location for an additional sight, as the barrel of the rifle is designed to remain aligned with the manual sight. This location for mounting an accessory rail provides a supplemental sight attached to the accessory rail with a reduced likelihood of misalignment after an initial calibration. When an accessory rail is located on the stock, drift from the calibrated position is possible with a shift in position of the barrel relative to the stock.

FIG. 1 illustrates an accessory mounting rail 100 according to an embodiment of the present invention. Accessory mounting rail 100, as illustrated, provides three sets of mounting rails, though one of skill in the art will readily appreciate that other configurations having a different number of rails are fully contemplated, and are not outside the scope of the present invention. Accessory mounting rail 100 is formed by the assembly of side 102 and side 104. Side 104 has a rail 106 and in conjunction with side 102 forms a second rail 108 which resides at the base of accessory mounting rail 100. Side 102 has a rail, not shown in FIG. 1, similar to rail 106. Side 102 and side 104 meet at their bottoms, where they are hingedly attached to each other about pivot pin 110, using the clevis and tongue arrangement illustrated. The clevis and tongue attachment of sides 102 and 104 of the illustrated embodiment forms rail 108. It is anticipated that a similar construction can be formed where rail 108 is present in its entirety on one of sides 102 or 104, or where an alternate hinge design is employed. With a pivot around pivot pin 110, accessory mounting rail 100 can be opened so that it can wrap around the barrel of a rifle, with the rifle barrel sitting in cavity 114 which is defined by indentations in each of sides 102 and 104. The indentations form cavity 114 which, in this embodiment, has circular aperture 116 and domed aperture 118. The barrel of a rifle can be situated in the circular aperture 116, while a portion of the manual sight on the workpiece is situated in domed aperture 118. In operation, accessory mounting rail 100 is opened and the barrel of a rifle is seated in the expanded cavity 114. Accessory mounting rail 100 is then closed by pivoting about pivot pin 110, bringing sides 102 and 104 together. This secures the barrel of the rifle in circular aperture 106, and the manual sight in domed aperture 118. This attachment to both the rifle barrel and the sight prevents both rotation and lateral displacement along the axis of the barrel. To secure accessory mounting rail 100 in the closed position, bolt 112 is used to secure sides 102 and 104 in a locked position. In a presently preferred embodiment, bolt 112 is threaded to engage with threads in side 102, though one of skill in the art will readily appreciate that a number of other fasteners can be used for the same effect.

Though as illustrated in FIG. 1, accessory mounting rail 100 opens and closes by pivoting around pivot pin 110, it is anticipated that another embodiment can be produced by having sides 102 and 104 secured at the top and bottom by bolts or other securing devices. The use of bolts in place of pivot pin 110 will change the method of attachment, and will require that the two pieces be held together around the barrel of the rifle and then bolted into place in at least two locations.

Figure 2:
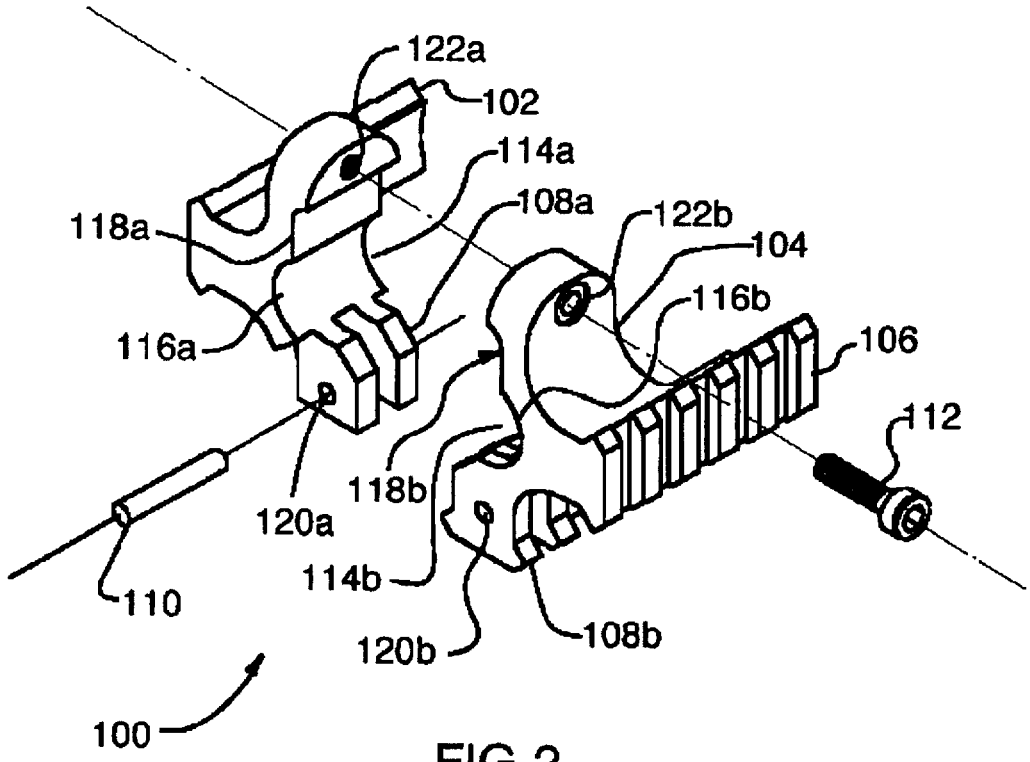
FIG. 2 is an exploded illustration of the accessory mounting rail of the FIG. 1.

FIG. 2 is an exploded view of accessory mounting rail 100. Side 102 has a rail whose face is not shown, rail portion 108*a* which has aperture 120*a* through which pivot pin 110 is placed, and recess 114*a*. Recess 114*a* is formed from semicircular recess 116*a* and half domed aperture 118*a*. Atop side 102 is aperture 122*a* in which bolt 112 is secured. In the presently preferred embodiment, aperture 112*a* is threaded to engage the threads of bolt 112 so that it can be secured without the need of a nut on the far side. Side 104 has rail 106, rail portion 108*b* which has aperture 120*b* which aligns with aperture 120*a* to accept pivot pin 110, and cavity 114*b*. Cavity 114*b* is formed from semicircular aperture 116*b*, and half domed aperture 118*b*. Cavity 114*b* is aligned with cavity 114*a* when sides 102 and 104 are connected to form cavity 114 as shown in FIG. 1. Atop side 104 is aperture 122*b*, which is sized to receive bolt 112, and is aligned with aperture 122*a*. In a presently preferred embodiment, aperture 122*b* is not threaded, so that bolt 112 can pass through without obstruction, and engage the threads of aperture 122*a*.

Figure 3:
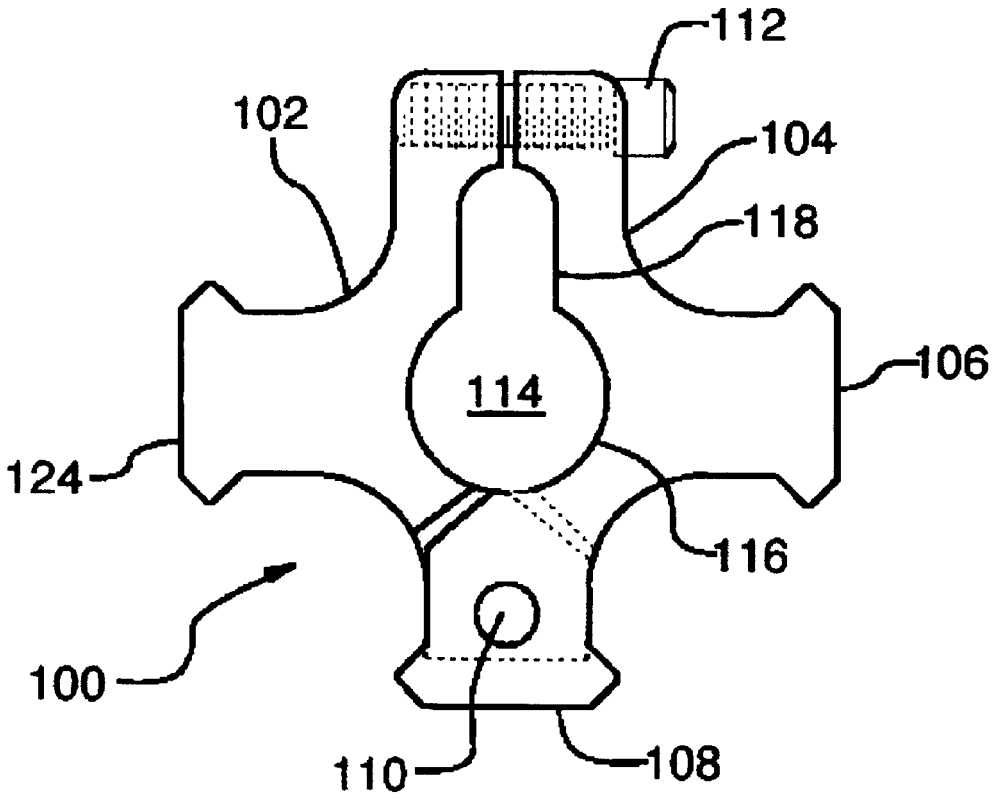
FIG. 3 is a front view of the accessory mounting rail of FIG. 1.

FIG. 3 presents a front view of the accessory mounting rail 100. Sides 102 and 104 are in a closed position, and are held secure by bolt 112. Side 104 provides rail 106, while side 102 provides rail 124, and in combination they provide rail 108. Complementary recesses 114*a* and 114*b* define aperture 114, which is the combination of circular cavity 116 and domed cavity 118. Sides 102 and 104 are secured to each other by pivot pin 110, about which they can pivot, with respect to each other, and bolt 112.

Figure 4:
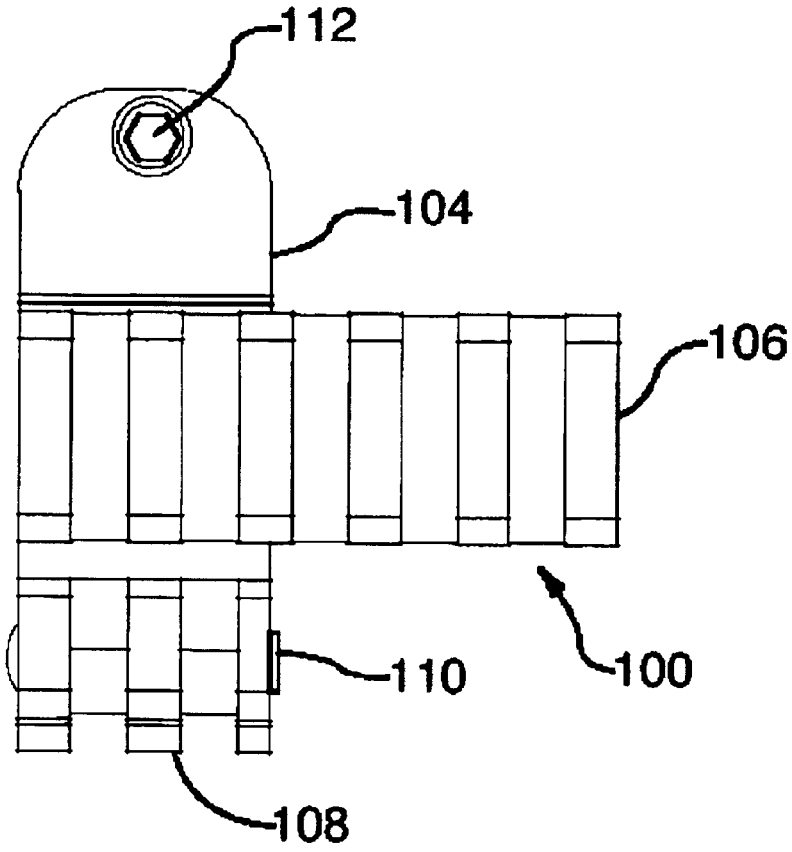
FIG. 4 is a left side view of the accessory mounting rail of FIG. 1.

FIG. 4 illustrates a left side view of accessory mounting rail 100. Side 104 provides rail 106 and in conjunction with side 102, not shown, it provides rail 108. Side 104 is pivotally attached to side 102 by pivot pin 110, and is secured in the closed position by engagement of bolt 112 with side 102. A right side view is not presented, but one of skill in the art will appreciate that it is substantially similar.

Figure 5:
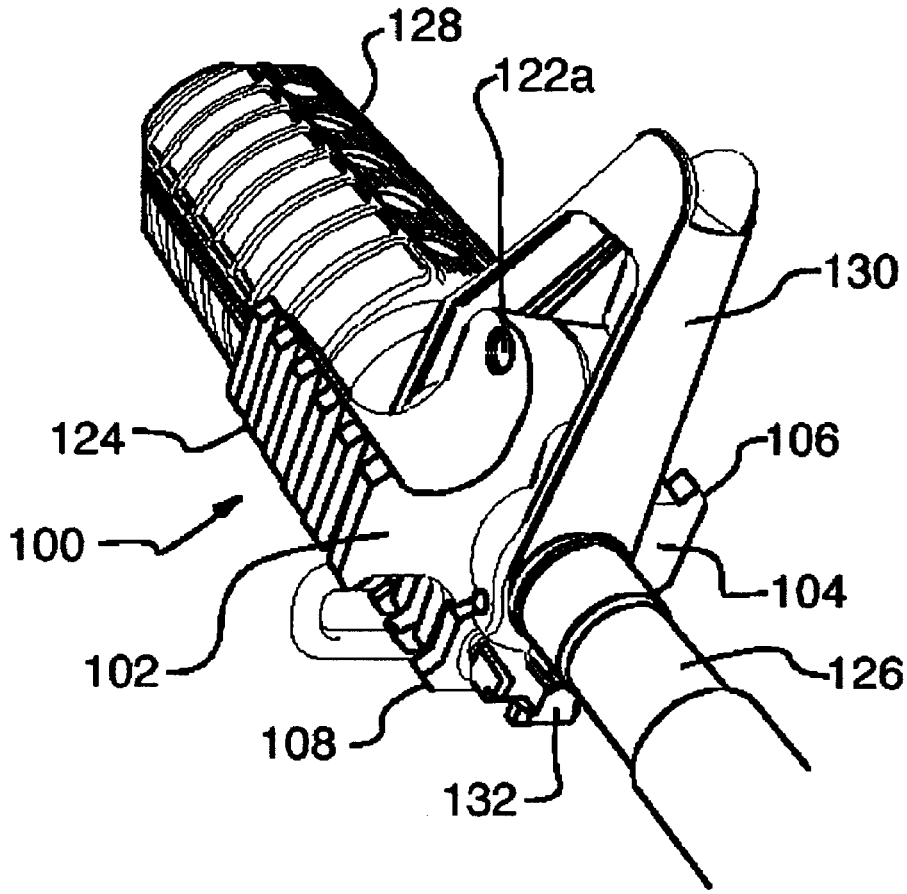
FIG. 5 is an illustration of the accessory mounting rail of the FIG. 1 engaging the barrel of a rifle in the closed position.

FIG. 5 illustrates the engagement of accessory mounting rail 100 to a rifle. Side 102 provides rail 124, while side 104 provides rail 106, and in combination they provide rail 108. Side 102 also provides a aperture 122*a*, to which bolt 112 not illustrated, is secured to hold the sides together. Accessory mounting rail 100 is secured to the barrel 126 of the rifle and to the sight 130. Sight 130 is secured to barrel 126, and has afront attachment 132 which is closer to the end of the barrel than accessory mounting rail 100. Behind sight 130 and accessory mounting rail 100 is handguard 128. Accessory mounting rail 100 is secured inside the area under the top of sight 130, and so it cannot shift forward or back nor can it rotate about barrel 126.

Figure 6:
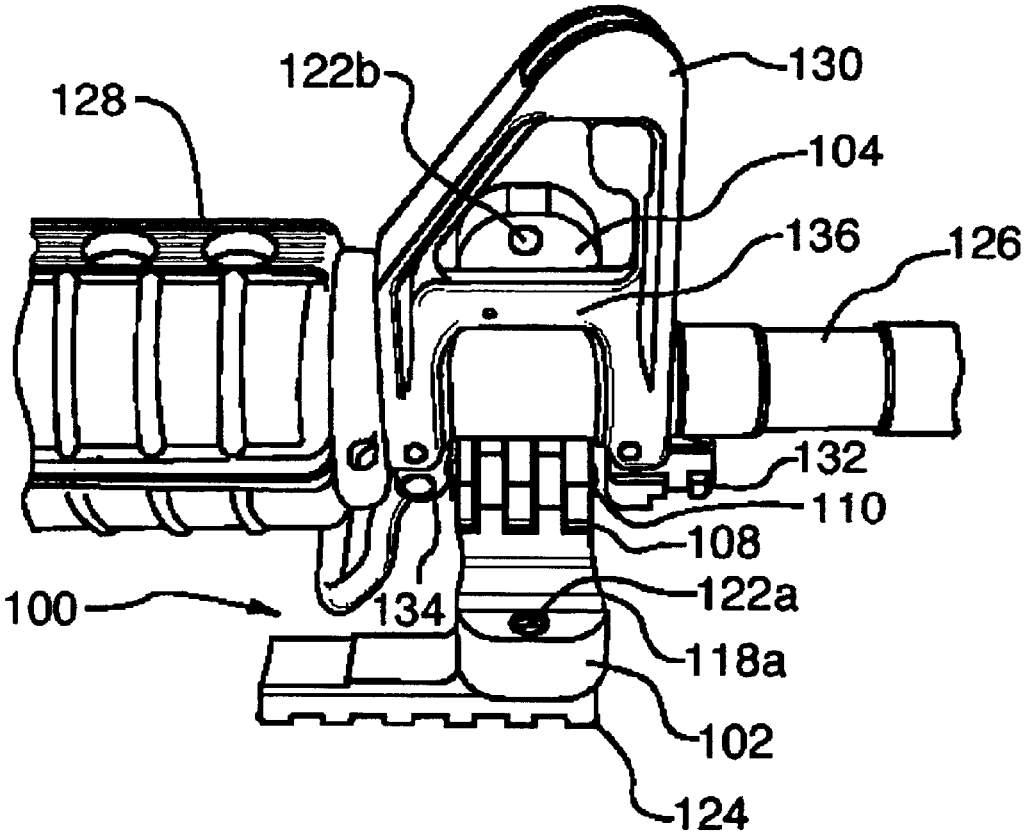
FIG. 6 is an illustration of the accessory mounting rail of FIG. 1 in an open position around the barrel of a rifle.

The attachment of accessory mounting rail 100 to the barrel 126 of the rifle is further illustrated in FIG. 6, which shows accessory mounting rail 100 in an open position. Side 102 is shown pivoted away from barrel 126. Rail 124 is no longer adjacent the side of barrel 126, and rail 108 is disrupted by the pivoting around pivot pin 110. Apertures 122*a* and 122*b* are separated, but when closed receive bolt 112 not shown. Sight 130 is secured to barrel 126 with closures 132 and 134, which lie to the front and back of accessory rail mount 100 with respect to barrel 126. Sight 130 has lateral brace 136, around which half domed recess 118*a* closes. When closed, recesses 118*a* and 118*b* (not shown) will engage lateral support 136 to prevent rotation of accessory mounting rail 100 with respect to the axis of barrel 126. Closures 132 and 134 prevent movement of accessory mounting rail 100 in line with the axis of barrel 126 if bolt 112 is insufficiently tight to prevent movement when the barrel is subject to the stresses of operation of the rifle.

In a presently preferred embodiment, accessory mounting rail 100 is made of aluminium, and is anodised black, so that it is substantially similar in colour to conventional firearms, and reduces the likelihood that it will reflect incident light. One of skill in the art will readily appreciated that the choice of material, and colour, are preferred features that can be varied so long as the accessory mounting rail is still capable of secure attachment to the barrel of the firearm. The selection of aluminium allows accessory mounting rail 100 to be light, and not greatly contribute to an increase of the mass of the firearm. A large increase in mass is not desirable due to the effects on firearm dynamics and reliability, furthermore a heavier firearm is generally not preferred by the user.

One of skill in the art will appreciate that though the presently preferred embodiment of the accessory mounting rail provides a plurality of locations at which an accessory can be mounted, it is possible to provide a single mounting rail within the scope of the present invention. Bolt 112 provides a simple method of attachment so that the accessory rail can be easily attached and removed from the firearm, however bolt 112 can easily be replaced with other known attachment means without departing from the scope of the present invention. Additionally, though pivot pin 110 is desirable as it simplifies attachment of accessory mounting rail 100 to the barrel of the rifle under the sight, attachment of another embodiment of the accessory mounting rail can be affected by bolting two disjoint pieces together, much as the top edge of the illustrated embodiment is secured by bolt 112. Whereas the present invention provides rail 108 through the interlacing of sides 102 and 104, this rail could be either omitted, or provided wholly on one of the sides. Furthermore, though the presently preferred embodiment has the rails integral to each side of the accessory mounting rail it is anticipated that the rails could be separate elements secured to the mounting bracket portion of the accessory mounting rail through the use of rivets, other fasteners or chemical bonding agents that are designed with withstand the stresses imposed on an "in-service" firearm.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A firearm accessory mounting rail for attachment of a firearm accessory to the barrel of a firearm having a sight attached to the barrel, the accessory mounting rail comprising:

an accessory rail for connection with the firearm accessory;

a mounting bracket provided on the accessory rail, for attachment to the barrel of the firearm and for engaging the sight to impede at least one of rotational movement of the accessory rail about with the axis of the barrel of the firearm and translational movement of the accessory rail in both directions along the axis of the barrel.

2. The firearm accessory mounting rail of claim 1, wherein the accessory rail is integrally formed with the mounting bracket.

3. The firearm accessory mounting rail of claim 1, wherein the mounting bracket is sized for attachment to the barrel under the sight.

4. The firearm accessory mounting rail of claim 3, wherein the mounting bracket is sized to abut the sight to impede movement of the accessory rail in line with the axis of the barrel.

5. The firearm accessory mounting rail of claim 1, wherein the mounting bracket is formed of two complementary sides, each side having a complementary recess that in combination define an aperture through which the barrel can be secured.

6. The firearm accessory mounting rail of claim 5, wherein each complementary side has an integrally formed accessory rail.

7. The firearm accessory mounting rail of claim 5, wherein the complementary sides are pivotally hinged to each other at their bases.

8. The firearm accessory mounting rail of claim 7, wherein the complementary sides interlace at the hinged end to form an accessory rail.

9. The firearm accessory mounting rail of claim 7, wherein the firearm accessory mounting rail is securable to the barrel through the attachment of the complementary sides to each other, with a fastener.

10. The firearm accessory mounting rail of claim 5, wherein the recesses define an aperture sized to secure the mounting bracket to the barrel and at least a portion of the sight, to impede rotation of the accessory rail with respect to the axis of the barrel.

* * * * *